US006567344B1

(12) United States Patent
Auer

(10) Patent No.: US 6,567,344 B1
(45) **Date of Patent: *May 20, 2003**

(54) CLOCK

(75) Inventor: Gottfried Auer, Windsbach (DE)

(73) Assignee: Emerson Radio Corp., Parsippany, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/161,536

(22) Filed: Sep. 28, 1998

(30) Foreign Application Priority Data

Apr. 6, 1998 (DE) ..... 298 06 161 U

(51) Int. Cl.[7] ..... G04B 19/22; G04C 9/00
(52) U.S. Cl. ..... 368/21; 368/187
(58) Field of Search ..... 368/21, 22, 28, 368/29, 69, 185–187

(56) References Cited

U.S. PATENT DOCUMENTS

| | | | | | |
|---|---|---|---|---|---|
| 4,659,231 | A | | 4/1987 | Barkouki | |
| 4,995,020 | A | * | 2/1991 | Mitchell | 368/21 |
| 5,490,122 | A | * | 2/1996 | Kojima | 368/21 |
| 5,499,220 | A | * | 3/1996 | Gasplard | 368/21 |
| 5,555,226 | A | * | 9/1996 | Hizzi | 568/21 |
| 5,920,824 | A | * | 7/1999 | Beatty et al. | 435/550 |

FOREIGN PATENT DOCUMENTS

| | | |
|---|---|---|
| DE | 296 08 563 U1 | 9/1996 |
| EP | 0 652 497 A2 | 5/1995 |

* cited by examiner

*Primary Examiner*—Vit Miska
(74) *Attorney, Agent, or Firm*—Darby & Darby

(57) ABSTRACT

Method and apparatus for automatically displaying a correct time and date when initially activating a clock. After manufacture of the clock and before it is purchased by the user, a basic data set, including the time and geographical region data, are input to the clock via an interface. The data are stored in a memory of a microcontroller. After purchase by a user, the clock is plugged into a power grid and the correct time and date are displayed without the need to set the clock.

26 Claims, 1 Drawing Sheet

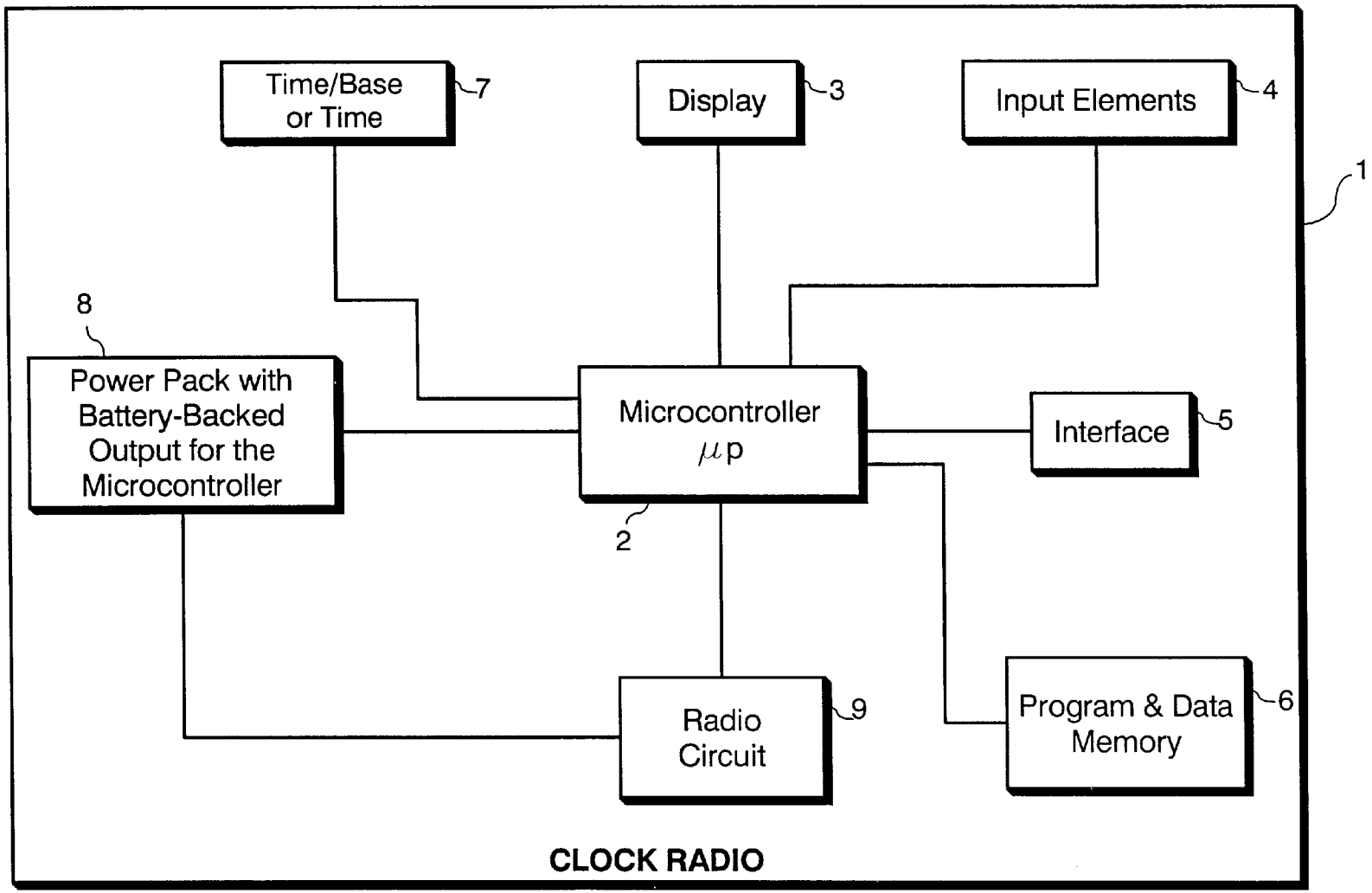
1
4
Input Elements
3
Display
7
Time/Base or Time
5
Interface
Microcontroller μp
2
8
Power Pack with Battery-Backed Output for the Microcontroller
6
Program & Data Memory
9
Radio Circuit
CLOCK RADIO

CLOCK

BACKGROUND OF THE INVENTION

1. Field of the Invention

The invention generally relates to the field of clocks and, more particularly, to a clock or clock having a time and date display. The clock can also be made as a clock with a wake-up function or as a radio alarm.

2. Description of the Related Art

Clocks, and in particular clocks that have date and time displays, are known. Specifically, clock radios which, after being started by a buyer, set themselves automatically to the actual time are known. In some cases, such clocks set themselves to display the actual date. However, automatic time setting, as well as automatic date setting only occurs when a time data signal transmitted by radio (e.g., the DCF77 time mark signal transmitted in Germany) at the location of the clock can be received by the clock with a sufficient level of quality. The receipt of such a time mark signal is not always guaranteed.

It is therefore apparent that there is a need for a clock that sets its time independently from the reception of a time data signal that is transmitted via radio waves.

SUMMARY OF THE INVENTION

The invention is a method and apparatus for automatically displaying a correct time and date when initially activating a clock. In accordance with the invention, after the manufacture of the clock and before it is purchased by a user, the actual time is input to the clock via an electro-mechanical interface. In the preferred embodiment, the actual date or a corresponding data set input to the clock via the electro-mechanical interface. The clock then continues to run and correctly displays the actual time. This is accomplished by using a program that is stored in memory and/or by using data necessary for correctly displaying the time that are also stored in the memory. In preferred embodiments, the clock displays time and date information.

In the clock, the data necessary for displaying the correct time, and for optionally displaying the correct date, contain data such as calendar data that is stored in the memory of the control circuit or microcontroller. In preferred embodiments, the data comprises an "eternal" calendar with leap year, date and time of reset from summer to winter time and vice versa.

In accordance with the invention, setting of the clock is performed after completion and before purchase by the user, such as while the clock is still in production or when the clock is delivered to a dealer (distributor) or individual store. As a result, the user is provided with the correct time and date display when the clock is initially plugged into a power grid (i.e., a grid-power) and powered up because the clock starts without the need to reset the time and date, etc., of the clock.

Particularly in countries that have several time zones, it is possible for the user to choose the desired time zone via an input to the control circuit or microcontroller. The display shows the current time applicable to this time zone, and optionally the current date.

BRIEF DESCRIPTION OF THE DRAWING

The foregoing and other advantages and features of the invention will become more apparent from the detailed description of the exemplary embodiments of the invention given below with reference to the accompanying drawings in which:

The sole FIGURE is a schematic block diagram of a grid-powered clock radio in accordance with the invention.

DETAILED DESCRIPTION OF THE PREFERRED EMBODIMENT

The sole FIGURE is a schematic block diagram of a clock radio in accordance with an exemplary embodiment of the invention. As shown therein, the central element of a clock radio 1 is a microcontroller 2 to which, among others, the following functional elements are assigned:

display 3;

input elements 4;

electro-mechanical interface 5;

program and data memory 6; and time base or master clock 7.

The display 3 is a digital display, such as a Liquid Crystal Display (LED). In alternative embodiments, the display has clock hands for representation of the time in much the same way that a clock having a minute hand, a second hand, and a hour hand would display the time.

With further reference to the FIGURE, input elements 4 are used to set the function of the clock radio or radio alarm 1. In the preferred embodiment, input elements 4 are push buttons. The input elements 4 make it possible to set functions of the clock radio or radio alarm 1, such as the wake-up and alarm time for a user.

The time base 7 is a high precision, crystal-controlled time base that is synchronized to the main power supply frequency for the clock radio.

The microcontroller 2, and the function elements assigned to it, has a battery-buffered voltage supply 8. In the event that a grid or power failure occurs, the function of the microcontroller 2 and preservation of the data stored in the memory 6 are ensured.

Also included is a radio circuit 9 that possesses all the functional elements that are necessary for a radio, including a speaker. The radio circuit 9 is triggered by the microcontroller so that the radio is turned on at the alarm or wake-up time, for example. To supply the circuit 9, the voltage supply or power pack 8 is used without the need to battery buffer the supply.

One key aspect of the clock radio 1 of the present invention is that all calendar data, including an "eternal calendar", leap years, time of switching between summer/winter time and vice versa are stored in memory 6 as a basic data set (e.g., in a read-only memory or memory that has the properties or features of a ROM). By way of the electro-mechanical interface 5, when the clock radio 1 is sold, but preferably at the manufacturer or distributor or retailer, the clock radio 1 is set to the current time and date that is valid for the respective sales region. The data are read digitally via a setting means, such as a computer with a corresponding setting program, into memory 6 and stored there. Proceeding from the data set via the interface 5, and then by way of the signal generated by time base 7, the data displayed on the display 3 are updated (e.g., time, data, weekday, etc.).

In geographical areas or countries that have several time zones, the setting is performed for a certain stipulated time zone (base time zone). Using the input elements 4, a user of the clock selects his time zone by inputting the time that corresponds to the specific time zone in which he is located. From the data for the base time zone, the microcontroller 2 determines the data for the time zone selected by the user and stores them in the memory 6 as the base for further representation of the time and date on the display 3.

Alternatively, it is possible to input the current data (date, time, etc.) for all time zones by way of the electro-mechanical interface 5 when initially setting the clock.

Regardless of how the clock is set, it holds that when clock radio 1 is powered up and started for the first time, display 3 shows the current time, the current date and the current day of the week, without the need to specifically set the clock. Important elements of the above described clock radio 1, especially the microcontroller 2, the memory 6 assigned to it and components of the time base 7, can be combined in one semiconductor chip.

The above invention was described using the example of a clock radio. It goes without saying that a clock or alarm clock can be made in the same manner, where the radio circuit 9 is omitted.

What is claimed is:

1. A method for presetting a clock having an electronic control circuit, interface means assigned to the electronic control circuit, a time display, an electronic control circuit, and a time base, and memory cooperating with the electronic control circuit, the memory storing data necessary for displaying correct information on the display, the method comprising the steps of:

prior to distribution of the clock, loading into the clock a basic data set comprising geographical region data and time of day data in the geographical region by way of a person operating a setting means that communicates with the electronic control circuit via the interface means, each said time of day data of said basic data set being associated with a specific geographic region in which the clock is destined for use; and updating the display by way of the time base during transport of the clock such that a correct time associated with the specific geographic region in which the clock is destined for use is displayed on the clock upon connecting the clock to a power grid;

wherein upon connecting the clock to the power grid, the basic data set is used by the electronic control circuit to automatically calculate a time associated with the specific geographic region to display on the clock at least one of a current time, a current date and a current day of the week at the specific geographic region that the clock is in use.

2. The method of claim 1, further comprising the step of:

setting at least one of a current time, a current date and a current day of the week associated with the region in which the clock is in use via the interface.

3. The method of claim 1, further comprising the step of:

inputting current data of all time zones when setting the clock via the interface means.

4. The method of claim 1, wherein the basic data set comprises calendar data.

5. The method of claim 4, wherein the calendar data comprises at least one of an eternal calendar, leap years and time of switching backward and forward between summer/winter time for the specific region.

6. The method of claim 1, wherein a user of the clock selects a time zone associated with which region the clock is located in.

7. The method of claim 4, wherein the calendar data is read into the memory via the interface means.

8. The method of claim 1, wherein the user of the clock sets at least one of a current time, a current date and a current day of the week associated with the specific geographic region.

9. The method of claim 1, wherein the specific geographic region is a geographical region in a specific time zone.

10. The method of claim 1, wherein the electronic control is a microcontroller.

11. The method of claim 1, wherein the memory stores calendar data for displaying the correct date and time adjustments for daylight savings time.

12. The method of claim 1, further comprising the step of:

switching time data to different geographical time zones via an input which interacts with the electronic control circuit.

13. The method of claim 1, wherein the clock is a clock radio.

14. The method of claim 1, further comprising the step of:

applying a back-up power source to the clock upon a main power supply failure to ensure preservation of data stored in the memory.

15. The method of claim 14, wherein the back-up power source is a battery.

16. The method of claim 1, wherein the setting means comprises a personal computer.

17. The method of claim 1, wherein the interface is an electro-mechanical interface that connects to a personal computer.

18. The method of claim 1, wherein the basic dated set is uploaded to the clock one of prior to final assembly of the clock at a dealer and at an individual retail store by the person.

19. A clock having an electronic control circuit, a time display and a time base, comprising:

means for uploading a basic data set comprising geographical region data and time of day data in the geographical region to the electronic control circuit subsequent to assembly of the clock, each said time of day of said basic data set being uploaded from a setting means that is in operative communication with the electronic circuit;

memory cooperating with the electronic control circuit, said memory storing the basic data set comprising the geographical region data and the time of day data in the geographical region that is associated with a specific geographic region of a country in which the clock is destined for use; and a device connected to the electronic circuit for powering the clock; said device being battery buffered to provide a continuous power source during transport of the clock; and time updating means for updating the display by way of the time base during transport of the clock such that a correct time associated with the specific geographic region in which the clock is destined for use is displayed on the clock upon connecting the clock to a power grid;

wherein upon connecting the clock to the power grid, the basic data set is used by the electronic control circuit to automatically calculate a time associated with the specific geographic region to display on the clock at least one of a current time, a current date and a current day of the week at the specific geographic region that the clock is in use.

20. The clock of claim 19, wherein the electronic control is a microcontroller.

21. The clock of claim 19, wherein the memory stores calendar data for displaying the correct date and time adjustments for daylight savings time.

22. The clock of claim 19, wherein the device for powering the clock is a battery.

23. The clock of claim 19, wherein the clock is a clock radio.

24. The method of claim 19, wherein the specific region is a geographical region in a specific time zone.

25. The clock of claim 19, further comprising:

input elements cooperating with the electronic control circuit; said input elements adapted to select at least one of a current time, a current date and a current day of the week.

26. The clock of claim 19, wherein the interface is an electro-mechanical interface that connects to a personal computer.

* * * * *